United States Patent [19]

Cholin et al.

[11] Patent Number: 4,553,031

[45] Date of Patent: Nov. 12, 1985

[54] OPTICAL FIRE OR EXPLOSION DETECTION SYSTEM AND METHOD

[75] Inventors: John M. Cholin, Oakland; Ray Voorhis, Midland Park, both of N.J.; Jeffrey G. Cholin, Pound Ridge, N.Y.

[73] Assignee: Firetek Corporation, Hawthorne, N.J.

[21] Appl. No.: 529,275

[22] Filed: Sep. 6, 1983

[51] Int. Cl.[4] ..... G08B 17/12

[52] U.S. Cl. ..... 250/339; 340/578; 250/340

[58] Field of Search ..... 250/339, 554, 340; 340/578, 587, 577

[56] References Cited

U.S. PATENT DOCUMENTS

| | | | |
|---|---|---|---|
| 2,762,034 | 9/1956 | Joyce et al. | 340/578 |
| 3,742,474 | 6/1973 | Muller | 250/207 |
| 4,157,506 | 6/1979 | Spencer | 340/577 |
| 4,160,163 | 7/1979 | Nakauchi | 250/339 |
| 4,249,168 | 2/1981 | Muggli | 250/339 |
| 4,280,058 | 7/1981 | Tar | 250/339 |

FOREIGN PATENT DOCUMENTS

| | | | |
|---|---|---|---|
| 4411220 | 7/1966 | Japan | 340/578 |

*Primary Examiner*—Alfred E. Smith
*Assistant Examiner*—Carolyn E. Fields
*Attorney, Agent, or Firm*—W. Patrick Quast

[57] ABSTRACT

There is disclosed a fire and explosion detection system and method comprising at least one first channel including a photocell and accompanying electronics for converting incident radiant energy of a first narrow band of wavelengths into a first electric signal; and, at least one type of second channel means including a photocell and accompanying electronics for producing a second electrical signal proportional to incident radiant energy of a second narrow band of wavelengths corresponding to background, black body emissions. The signal outputs of these two channels are further processed by a ratio detection circuit which produces yet another output electrical signal when the ratio of the two input signals exceeds a predetermined number. The output of this ratio detection circuit is further processed by a so called flicker frequency detection circuit which counts pulses indicative of the flicker frequency of the fire and gives a first warning if that flicker frequency exceeds a predetermined number. Additional circuit means process the output of the ratio detection circuit to determine if that signal exceeds a predetermine magnitude to indicate the presence of an explosion or flash fire. An overload protection circuit is included to inhibit the alarm function of the invention in the situation where the detector is first exposed to sunlight, incandescent light, etc. having characteristic emissions in the band widths of the two photocells. Representative wavelengths for the two channels are described. In particular, the black body emission channel is set at 3.8 microns while the other channel is set at 4.3 microns.

15 Claims, 1 Drawing Figure

OPTICAL FIRE OR EXPLOSION DETECTION SYSTEM AND METHOD

TECHNICAL FIELD

This invention relates generally to a fire or explosion detection system and more particularly to a dual channel optical system which provides increased sensitivity to actual fire conditions and yet immunity to false alarm conditions.

BACKGROUND

When handling combustible liquids and gases the probability of a fire is so high and the expansion of the fire so rapid that the optical detection technique is the only one which is fast enough to be of use. The fire protection industry has witnessed several attempts at an acceptable optical flame or explosion detection system. However, with each of the techniques used in the past, there have been problems with either inadequate sensitivity or alarm signals from radiation sources other than fire.

Historically, the most effective detection has been with ultra-violet optical detectors. However, these devices are sensitive to arc-welding, lightning and X-rays and thus are plagued with false alarms.

Infra red devices have been used as well. The most successful have been the dual channel devices which compare the emissions at 4.3 microns, characteristic of $CO_2$ and CO, the by-products of hydrocarbon fires, and 3.8 microns which is a black body emission band. These devices have been limited by the inherent sensitivity of the photocells used. Efforts have been made to improve the performance of the infra-red devices with signal processing circuitry which has been used to superimpose restrictions on the signals to eliminate the possibility of alarm signals due to spurious infra-red emitters.

Various inventions exist which approach the resolution of the flase-alarm problem, but none provide an adequate circuit topology to provide sufficient sensitivity without exposure to false alarms. Hertzberg et al, U.S. Pat. No. 3,859,520, described an explosion detection system which is designed to detect methane explosions. This invention uses three optical channels, one centered on 4.4 microns, and the other two at the sidebands of this band. The idea he presents is that one can use the sidebands as references in a bridge or comparator circuit. When the bridge or comparator circuit detects an imbalance, the alarm output is given. This technique will work where the fuel is limited largely to pure methane. However, real world fires and explosions seldom take place in a manner such that the spectral peak that Hertzberg describes actually exists. In real fires there is broadband, black body radiation superimposed upon the radiation emitted during the oxidation of free radicals and the combustion intermediates which contain more than one carbon to carbon bond. This extraneous radiation makes the simple comparator circuit or bridge circuit ineffective for the detection of the ratios which Hertzberg describes.

Nakauchi, U.S. Pat. No. 4,160,163, describes an invention wherein two channels of optical radiation are converted to electronic signals and the ratio of the two signals are calculated. If the ratio exceeds a predetermined level, the signal is supplied to a subtraction circuit which processes the ratio signal with the 4.4 micron signal and a portion of the 3.8 micron signal. This invention superimposes upon the signals generated by the two bands of radiation an arithmetic process to reduce the exposure to false alarms. The level detection circuit and the arithmetic division and subtraction circuits reduce the sensitivity of the detector to the point where it becomes impractical as a fire detector.

In U.S. Pat. No. 4,220,857, Bright, the inventor, requires the signal from each channel of incident radiation to excede a predetermined level as protection against false alarms. In doing so the detector requires a larger amount of radiation than that which is necessary to satisfy the differential or ratio circuit in order to contribute to stability. Thus its sensitivity is reduced. Bright tried to improve this by reducing the noise level on the input channels with "phase sensitive demodulators". However, the major source of noise is internally generated random electron noise which is not reduced by this circuit. Consequently, even this device provides less sensitivity to a fire than the traditional ultra-violet vacuum photo diode used with competitive u.v. detection systems.

Cinzori, U.S. Pat. No. 3,931,521, and Mc Menamin, U.S. Pat. No. 3,665,440 also have used the technique of using two channels of radiation to detect a fire. However, these inventions use emissions which are very different in wavelength and without signal processing circuitry to prevent false alarms. These inventions are less proficient than those already cited.

It is therefore a primary object of this invention to provide a dual channel infra red detection system with both a high degree of sensitivity to various fire conditions and immunity to false alarms.

It is yet another object of this invention to provide a detection system which can detect both flickering and flash fires with a high degree of sensitivity, while still retaining an immunity to false alarms.

It is still another object of this invention to provide a detection system which includes circuitry to prevent overloading and subsequent false alarms due to direct exposure to sunlight.

DISCLOSURE OF THE INVENTION

Towards the accomplishment of these and other objectives which will become apparent from a reading of the accompanying description, there is disclosed a fire and explosion detection system and method comprising at least one first channel including a photocell and accompanying electronics for confirming incident radiant energy of a first narrow band of wavelengths into a first electric signal; and, at least one type of second channel means including a photocell and accompanying electronics for producing a second electrical signal proportional to incident radiant energy of a second narrow band of wavelengths corresponding to background, black body emissions. The signal outputs of these two channels are further processed by a ratio detection circuit which produces yet another output electrical signal when the ratio of the two input signals exceeds a predetermined number. The output of this ratio detection circuit is further processed by so called flicker frequency detection circuit which counts pulses indicative of the flicker frequency of the fire and gives a first warning if that flicker frequency exceeds a predetermined number. Additional circuit means process the output of the ratio detection circuit to determine if that signal exceeds a predetermined magnitude to indicate the presence of an explosion or flash fire. An overload protection circuit is included to inhibit the alarm function of the invention in the situation where the detector is first exposed to sunlight, incandescent light, etc. having characteristic emissions in the band widths of the two photocells.

DESCRIPTION OF THE DRAWINGS

A full grasp of the invention, its advantages, benefits and other objectives will be more readily apparent from a reading of the following description taken in conjunction with the accompanying drawings.

DESCRIPTION OF THE BEST MODE

Figure 1:
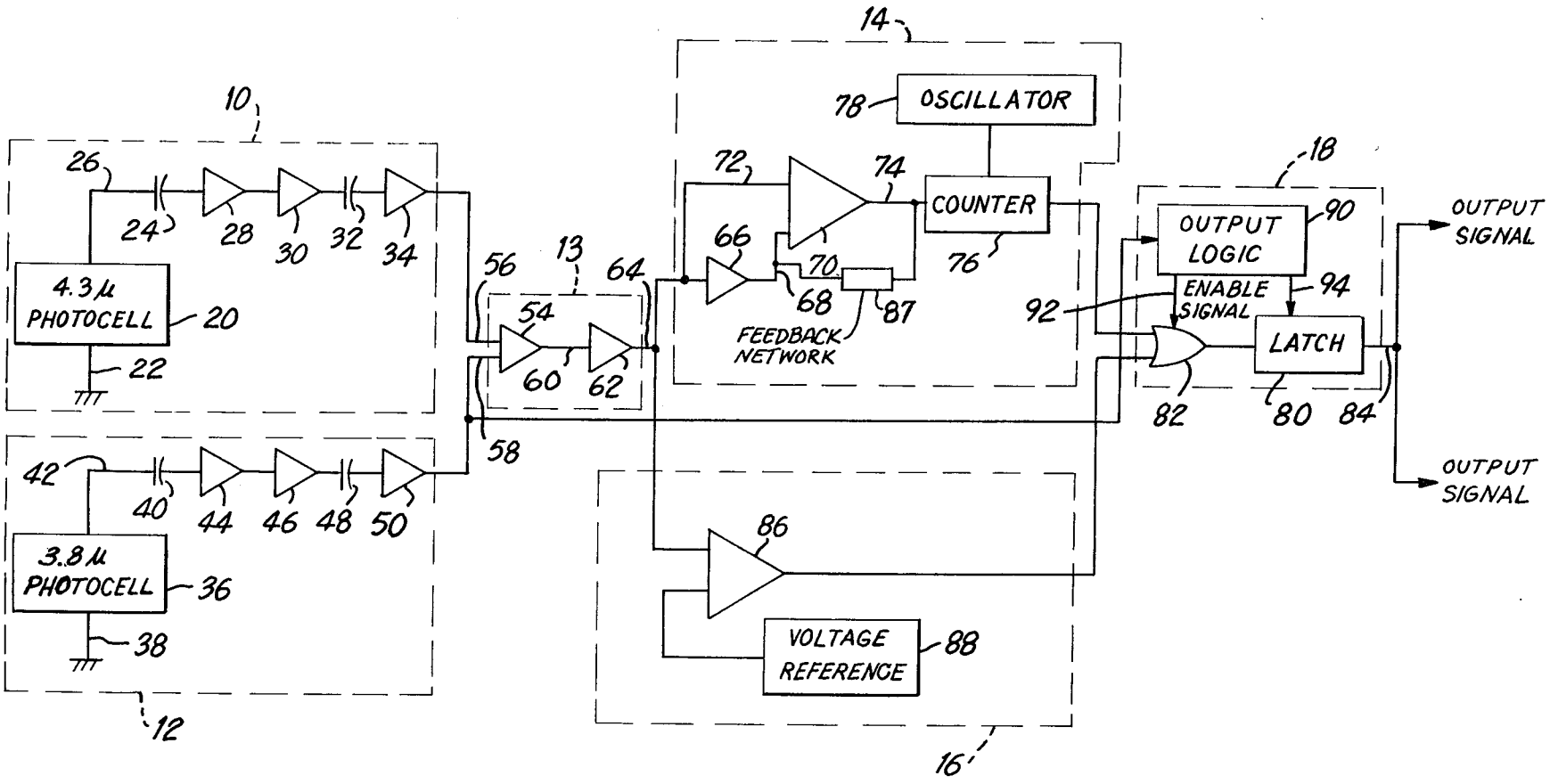
FIG. 1 is a functional schematic drawing of the improved fire and explosion detector in accordance with the present invention.

Referring to the electrical schematic, the present invention includes first channel means 10 and second channel means 12 which are connected through a differential ratiodetection circuit 13 to flicker detector circuitry 14 and flash detector circuitry 16. The outputs of the latter two circuts are connected to output logic and alarm circuitry 18. The latter produces suitable alarm type signal(s) which can be utilized by a monitoring system, video or audio alarm system, etc.

The following discussion describes a system responsive to the 4.3 micron and 3.8 micron bands in the infra red spectrum. It is to be understood that the invention can be used for any two (or more) bands in the spectrum and is not necessarily limited to 4.3 and 3.8 microns.

The first channel means 10 processes signals generated by 4.3 micron emissions such as emanate from various products of combustion and includes a photocell device 20 responsive to such emissions. The photocell includes an optical filter which limits the spectral response of the cell to a very narrow spectral band with a peak response to radiation at 4.3 micron wavelength. One side of the cell 20 is connected to electrical ground by lead 22. The output of the cell is connected to coupling impedance 24 through lead 26. The ac coupling enables very small signals to be recognized in the presence of large amounts of other type radiation; and prevents background radiation from initiating an alarm regardless of the steady-state temperature emissions.

Coupling impedance 24 feeds the signal to one or more stages of amplification such as serially connected amplifiers 28 and 30. Amplifiers 28 and 30 are standard off the shelf amplifiers.

Amplifier 30 provides the signal to coupling impedance 32. This in turn is connected to a rectifying amplifier, 34. This amplifier is also a standard operational amplifier with rectified output. It is biased by a suitable reference voltage such that only negative excurting pulses at the flicker frequency appear at the output.

It should be obvious to those skilled in the art that the number of amplifier stages and the type of interconnecting impedances are merely illustrative of this circuit topology and must not be misconstrued as definitive of the proposed invention.

Similarly, the second channel means 12 includes a photocell 36 connected to electrical ground by lead 38. This photocell includes optical filtering which provides a narrow band of wavelenths corresponding to background, black body emissions. In this embodiment the peak wavelength is 3.8 microns. The remaining circuitry is identical to the first channel means. Thus, the output of the photoelectric device is connected to coupling impedance 40 by lead 42. The signal is then supplied to amplifier stages 44 and 46; then coupling impedance 48; and, finally, rectifying amplifier 50. These various components are identical in type as to those described with respect to the first channel means.

There is however one significant difference between the two channels. The gain of the 3.8 micron channel, the second channel, has been set at 10% higher than the gain of the 4.3 micron channel as measured from the output of the photo cells to the output of the rectifying amplifiers 34 and 50.

This gain differential is a function of the anticipated black body emissions in the locale of the detectors and for the peak response wavelengths detected. For example, the black body emission curves for most body temperatures indicate that the incident radiation at 3.8 microns will be higher than at 4.3 microns. If the additional gain is introduced into the 3.8 micron channel, this will insure against false alarms due to spurious signals at these wavelengths. Only a fire will result in a sufficiently higher signal at 4.3 microns so as to override the effect of this additional gain, and thus substantially insuring an alarm response to a fire only.

After the signals are processed through the first and second channel means, the outputs of rectifying amplifiers 34 and 50 are supplied to the respective inputs of differential amplifier 54 where they are differenced. The output of amplifier 34 has been labeled 56 and is connected to the non-inverting input of the differential amplifier 54. The output of rectifying amplifier 50 has been identified by numeral 58 and is connected to the inverting input of amplifier 54. The output of differential amplifier 54 is supplied to the input of rectifying amplifier 62.

The combination of the two amplifiers with a 1.1 to 1.0 gain ratio, the rectification amplifiers and the differential amplifier combines to form a circuit which provides an output only when the ratio of 4.3 micron light to 3.8 micron light exceeds 1.1 to 1.0 and is of the correct polarity corresponding to a pulse of light.

For the embodiment described, if the 4.3 signal exceeds the predetermined ratio, then the signal pulses out of differential amplifier 54 will be negative going with respect to a reference voltage, otherwise they will be positive going. After going through rectifying amplifier 62, which also inverts the signal, only the positive going signals representing the 4.3 signals which are larger than the 3.8 are used. The negative going signals representing a 3.8 component which is larger than the 4.3 are rejected.

The differential amplifier thus calculates the ratio between the incident radiation at the two wavelengths. If the ratio exceeds 1.1:1 then a signal proportional to the amount of excess is emitted. This technique eliminates the possibility of an alarm to a black body emitter since the ratio of 4.3 to 3.8 radiation coming from a black body is below 1.1:1. Here again the choice of gain ratio of 1.1 to 1.0 is illustrative of the design concept and not limiting.

After processing through the differential and rectifying amplifiers, the signal is further analyzed in order to establish that it is the result of either of the two possible conditions: a developing fire; or a rapidly expanding fire such as an explosion or the like.

Consider the developing fire. Through experimentation it has been established that developing fires characteristically emit radiation at the 4.3 and 3.8 micron wavelengths. This includes both a low frequency signal (approx. 1 HZ); and a high freguency component (5 HZ to 20 HZ) riding on the low frequency component. The purpose of the so called "flicker" detection circuitry, 14, is to detect this high frequency component riding on the low frequency one in order to confirm the presence of the fire. The amplifier 66, acts as an averaging amplifier or active low pass filter, passing the low frequency component and filtering the "high" frequency component. In effect, this creates a floating reference level on its output 68. This reference level is in turn supplied to one input of a comparator 70. Input 72 of the comparator is connected to the output 64 of the rectifying amplifier 62. The result is that the output of the comparator 74 provides a pulse for each positively excurting pulse present on the input 72. Amplifier 66 and comparator 70 again are standard operational amplifiers.

The pulses at the output of the comparator 70 are supplied to a counter 76 which receives a periodic reset pulse from oscillator 78. In the particular embodiment, the latter oscillates at 0.33 HZ with the counter being reset every three seconds.

The counter is preset to a specified count. If the pulses received from the comparator reach the preset count between reset pulses from the oscillator, the counter ouput changes state. This operates the latch circuit 80 through Or gate 82.

The oscillator - counter circuit provides a filter circuit which can accumulate random or repetitive signals within a certain frequency and the number of counts required by the counter. The frequency window is set for the flicker frequency of hydrocarbon fires.

The preset count set in the counter can be varied depending on the type fire to be monitored. Various type fires have a characteristic "high" frequency component of the flicker frequency.

Output 84 of the latch circuitry provides the alarm signal to be received by any video or audio monitoring device, or more sophisticated equipment.

Some hydrocarbon fires progress so rapidly that it is appropriate to by-pass the flicker detection, which is designed to find a small fire in the presence of large amounts of background radiation. For example, with a large explosion or a fireball a large signal is immediately present and only one large "flick" occurs. To respond to this condition, the present detection system includes a so-called flash detector circuit 16. This comprises, essentially, comparator 86. One input of the comparator is supplied with a voltage reference 88 while the other input is connected to the output of rectifying amplifier 62. When the output of the differential amplifier 54 reaches a very high level, indicative of the flash fire, the comparator 86 switches. Again the latch circuit 80 is activiated through Or Gate 82 and the alarm signal generated.

Connected from the output of comparator 70 to input 68 is a resistive network 87 which introduces a small amount of positive feedback. This creates a dead band signal zone which eliminates triggering of the comparator by spuriously generated noise inherent in the photocells and circuit topology.

Overload circuitry is provided which obviates the possiblity of certain false alarms resulting from exposure of the detector to direct sunlight, artificial light, etc. This overload circuit included in output logic 90 is connected to the output of rectifying amplifier 50. If the detector is subjected to sunlight, for example, the transient signals in the two channels can approach and reach saturation level when first exposed to the light. This can result in a false alarm. The overload circuit, essentially a comparator, senses when the voltage at the output of the amplifier 50 is near saturation. Disabling signals occur on leads 92 and 94 which preclude operation by the gate 82 and latch circuit 80. Once the transient effect of the sunlight, lamp, etc. subsides at the output of the rectifying amplifier 50, the overload circuit changes state and disabling signals to gate 82 or latch circuit 80 become enabling signals and the circuit again is ready to detect a fire.

By combining a fire detection circuit and flicker detection circuit together a true high performance detector is possible with the stability and sensitivity to all possible fire conditions.

Variations to the above within the scope of the invention will now be obvious to those skilled in the art. For example, an extension of the basic design, would allow an application to multiple bands of radiation, for example, three.

In this situation, one (or more) of the channels would provide the reference, black body emitter information as performed by the 3.8 micron channel explained above. The remaining channels would sample bands of incident radiation about other peak response wavelengths. The ratio of the gains between the black body reference channel(s) and these other channels is set to preclude false alarms by black body emissions at the different wavelengths. The signal(s) from the reference channel(s) would be supplied together with respective channel signals to ratio detectors similar to item 13. Thereafter corresponding flicker frequency detection circuitry and flash detection circuitry would process the signal outputs of the ratio circuits as described above.

Still other variations of the above will be apparent while keeping within the breadth of the invention as defined in the appended claims.

What is claimed is:

1. A fire and explosion detection system comprising:

(a) at least one of a first channel means, including a first photocell, for the conversion of incident radiant energy of a first narrow band of wavelengths characteristic of a fire into a first electrical signal;

(b) at least one of a second channel means, including a second photocell, for the conversion of incident radiant energy of a second narrow band of wavelengths corresponding to background black body emissions into a second electrical signal;

(c) circuit means for determining the ratio between said first and second electrical signals, said means for determining the ratio producing a third electrical signal when the ratio of the first to the second electrical signal exceeds a predetermined number;

(d) first circuit means responsive to said third electrical signal to detect the flicker frequency, including a low and high frequency component, of said third electrical signal and to produce a first warning signal if the frequency of said high frequency component is a predetermined number, said first cirucit means including averaging amplifier means, comparator means and signal frequency counting circuit means, one input of said comparator means and the input to said averaging amplifier means connected to the output of said ratio determining circuit means, the output of said averaging amplifier means connected to a second input of said comparator means, the output of said comparator means connected to the input of said signal frequency counting means, the output of said signal frequency counting means producing said first warning signal, said averaging amplifier means filtering said third electrical signal to produce a floating reference signal at the input to the comparator means proportional to the low frequency component, the output of the comparator means producing a signal corresponding in frequency to the high frequency component of said third electrical signal, said signal frequency counting means producing said first warning signal when the number of cycles counted per period of time exceed a preset count; and, (e) second circuit means responsive to the magnitude of said third electrical signal to produce a second warning signal if the third electrical signal exceeds a predetermined signal magnitude.

2. The system claimed in claim 1 wherein said second circuit means includes a second comparator and reference signal generating means connected to one input of said second comparator, a second input of said comparator connected to the ouptut of said ratio determining circuit means, said second comparator producing a change in its output level when said third electrical signal exceeds in magnitude the signal generated by said reference signal generating means, said change in the second comparator output level corresponding to said second warning signal.

3. The system claimed in either claim 1 or claim 2 wherein the warning signals produced by said first and second circuit means are processed by output warning circuit means producing an output warning signal when either said first or second warning signals are present.

4. The system claimed in claim 3 wherein said second channel means includes overload circuit means responsive to the second electrical signal, said overload circuit means connected in circuit to said output warning circuit means, said overload circuit means inhibiting said output warning circuit means when said second electrical signal exceeds a predetermined level.

5. The system claimed in either claim 1 or 2 wherein the peak response to radiant energy of said first and second photocells is 4.3 micron and 3.8 micron respectively.

6. The system claimed in claim 1, wherein said first circuit means includes feedback circuit means connected from the output of said comparator means to a corresponding input thereof, for creating a dead band signal zone to obviate false triggering of said comparator means by random noise.

7. A fire and explosion detection system comprising:

(a) a first channel means, including a first photocell for the conversion of incident radiant energy of a first narrow band of wavelengths characteristic of a fire into a first electrical signal;

(b) a second channel means, including a second photocell, for the conversion of incident radiant energy of a second narrow band of wavelengths corresponding to background black body emissions into a second electrical signal;

(c) circuit means for determining the ratio between said first and second electrical signals, said means for determining the ratio producing a third electrical signal when the ratio of the first to the second electrical signal exceeds a predetermined number;

(d) first circuit means responsive to said third electrical signal to detect the flicker frequency, including a low and high frequency component, of said third electrical signal and to produce a first warning signal if the frequency of said high frequency component is a predetermined number, said first circuit means including averaging amplifier means, comparator means and signal frequency counting circuit means, one input of said comparator means and the input to said averaging amplifier means connected to the output of said ratio determining circuit means, the output of said averaging amplifier means connected to a second input of said comparator means, the output of said comparator means connected to the input of said signal frequency counting means, the output of said signal frequency counting means producing said first warning signal, said averaging amplifier means filtering said third electrical signal to produce a floating reference signal proportional to the low frequency component at the input to the comparator means, the output of the comparator means producing a signal corresponding in frequency to the high frequency component of said third electrical signal, said signal frequency counting means producing said first warning signal when the number of cycles counted per period of time exceed a preset count; and (e) second circuit means responsive to the magnitude of said third electrical signal to produce a second warning signal if the third electrical signal exceeds a predetermined signal magnitude; said second circuit means including a second comparator means and reference signal generating means connected to one input of said second comparator means, a second input of said second comparator means connected to the output of said ratio determining circuit means, said second comparator means producing a change in its output level when said third electrical signal exceeds in magnitude the signal generated by said reference signal generating means, said change in the second comparator means output level corresponding to said second warning signal.

8. The system claimed in claim 7 wherein the warning signals produced by said first and second circuit means are processed by output warning circuit means producing an output warning signal when either said first or second warning signals are present.

9. The system claimed in claim 8 wherein said second channel means includes overload circuit means connected in circuit to said output warning circuit means, said overload circuit means inhibiting said output warning circuit means when said second electrical signal exceeds a predetermined level.

10. The system claimed in either claim 1 or 7 wherein said first and second channel means each includes a.c. coupling impedance means for filtering electrical signals emanating from their respective photocells whereby the effects of background radiation and steady state temperature emissions are substantially reduced.

11. The system claimed in either claims 1 or 7 wherein said counting means includes means for varying the present count such that the number of cycles counted per period of time can be varied, such that said fire detection system can monitor for different type fires.

12. A method for detecting fire and explosions comprising the steps of (a) converting the incident radiant energy of a plurality of narrow wavelength bands into corresponding electrical signals, at least one of said narrow wavelength bands having a peak response at a wavelength characteristic of background black body emissions, at least another one of said narrow wavelength bands having a peak response at a wavelength characteristic of emissions of a fire;

(b) comparing the electrical signal(s) produced corresponding to the incident radiant energy in the band characteristic of background black body emissions, to the other electrical signal(s) produced in response to the fire emissions;

(c) taking the difference between the signals compared in step (b) and producing another electrical signal if the electrical signal(s) produced in response to the fire emissions compared to the background, black body emissions electrical signal exceeds the latter by a predetermined amount;

(d) processing the electrical signal produced in step (c), if the signal produced in step (c) includes a high and low frequency component, said processing step including processing the electrical signal produced in step (c) through two channels, one channel comprising supplying the signal produced in step (c) directly to a first input of comparator means, and a second channel for low pass filtering of said signal in step (c), said low pass filtered signal supplied to a second input of said comparator means, said low pass filtering substantially reducing said high frequency component at said second input, said processing step further comprising counting the number of cycles per period of time appearing in the signal produced by said comparator means and producing a first warning signal if the counted cycles exceed a predetermined number.

13. The method claimed in claim 12 further including processing the electrical signal produced in step (c), if the signal produced in step (c) exceeds a predetermined signal magnitude, to produce a second warning signal.

14. The method claimed in either claim 13 further including the step of responding electrically to the presence of either the first or second warning signal and producing an output warning signal when either one is present.

15. The method claimed in claim 14 further comprising the steps of:

(a) determining when the electrical signal produced corresponding to the incident radiant energy in the band characteristic of background, black body emissions exceeds a predetermined signal magnitude; and inhibiting the production of said output warning signal when said predetermined signal magnitude is exceeded by the background, black body emissions, electrical signal.

* * * * *